US007399535B2

(12) United States Patent
Yoshikawa et al.

(10) Patent No.: US 7,399,535 B2
(45) Date of Patent: Jul. 15, 2008

(54) HOT PRESS-FORMED ARTICLE

(75) Inventors: Yukihiro Yoshikawa, Kyoto (JP); Kazuhito Imai, Amagasaki (JP); Kunihiro Fukui, Kawanishi (JP); Tamotsu Toki, Nishinomiya (JP); Shuntaro Sudo, Toyota (JP); Akira Obayashi, Toyota (JP); Masanobu Ichikawa, Nisshin (JP)

(73) Assignees: Sumitomo Metal Industries, Ltd., Osaka (JP); Toyota Jodosha Kabushiki Kaisha, Aichi (JP); Toyoda Iron Works Co., Ltd., Aichi (JP)

( * ) Notice: Subject to any disclaimer, the term of this patent is extended or adjusted under 35 U.S.C. 154(b) by 0 days.

(21) Appl. No.: 11/254,641

(22) Filed: Oct. 21, 2005

(65) Prior Publication Data

US 2006/0121305 A1 Jun. 8, 2006

Related U.S. Application Data

(63) Continuation of application No. PCT/JP2004/005873, filed on Apr. 23, 2004.

(30) Foreign Application Priority Data

Apr. 23, 2003 (JP) ..... 2003-118903
Aug. 29, 2003 (JP) ..... 2003-307348

(51) Int. Cl.
*B32B 15/00* (2006.01)
*B32B 15/04* (2006.01)
*B32B 15/18* (2006.01)

(52) U.S. Cl. ..... 428/659; 428/632; 428/681; 428/335; 428/340

(58) Field of Classification Search ..... 428/658, 428/653, 659, 632, 629, 681, 682, 684, 219, 428/213, 215, 332, 334, 335, 336, 340, 341
See application file for complete search history.

(56) References Cited

U.S. PATENT DOCUMENTS 4,707,415 A * 11/1987 Ikeda et al. ..... 428/621

FOREIGN PATENT DOCUMENTS

JP 58-052494 * 3/1983
JP 58-52494 * 3/1983
JP 03-002391 1/1991

(Continued)

*Primary Examiner*—Michael La Villa
(74) *Attorney, Agent, or Firm*—Clark & Brody

(57) ABSTRACT

A hot press-formed article having improved corrosion resistance and coating adhesion when coated is obtained by hot press forming of a zinc-based plated steel material. It has a zinc-based plating layer comprising an iron-zinc solid solution phase and atop it a zinc oxide layer. The average thickness of the zinc oxide layer which is the outermost layer is at most 2 μm. A hot press-formed article having a good appearance and excellent corrosion resistance, coating adhesion, post-coating corrosion resistance, and weldability has a layer (2) consisting essentially of an iron-zinc solid solution phase atop a base material steel sheet (1). It also has a zinc oxide layer (3) with an average thickness of at most 5 μm as an uppermost layer, but it does not have a substantial amount of an iron-zinc intermetallic compound phase. The total amount of Al contained in the iron-zinc solid solution layer (2) and the zinc oxide layer (3) is at most 0.5 g/m$^2$, and/or the total amount of Al oxides contained in these layers is at most 5 mg/m$^2$.

3 Claims, 1 Drawing Sheet

FOREIGN PATENT DOCUMENTS

| | | | |
|---|---|---|---|
| JP | 2000-038640 | | 2/2000 |
| JP | 2000-054161 | | 2/2000 |
| JP | 2000-160358 | | 6/2000 |
| JP | 2001-353548 | | 12/2001 |
| JP | 2002-012958 | | 1/2002 |
| JP | 2002-102980 | | 4/2002 |
| JP | 2002-282951 | | 10/2002 |
| JP | 2003-002058 | | 1/2003 |
| JP | 2003-073774 | | 3/2003 |
| JP | 2003-126921 | * | 5/2003 |
| JP | 2004-323897 | | 11/2004 |

* cited by examiner

HOT PRESS-FORMED ARTICLE

CROSS-REFERENCE TO RELATED APPLICATIONS

This application is a continuation of International Patent Application No. PCT/JP2004/005873 filed on Apr. 23, 2004. This PCT application was not in English as published under PCT Article 21(2).

TECHNICAL FIELD

This invention relates to a hot press-formed article of a steel material having a high strength and excellent post-coating corrosion resistance and coating adhesion when coated, and to a method for its manufacture. A hot press-formed article and a method for its manufacture according to the present invention are particularly useful for the manufacture of parts requiring high strength and corrosion resistance such as the suspensions and reinforcing members of automobiles.

BACKGROUND ART

In recent years, with the object of achieving weight reduction of automobiles, which leads to improvements in the fuel efficiency thereof, efforts at reducing the weight of steel sheets used in automobiles by using steel sheets having an increased strength are progressing. However, if the strength of steel sheets becomes high, when automotive parts are manufactured by press forming, problems occur such as the occurrence of galling or breakage of steel members, or the shape of formed articles becoming unstable due to the spring-back phenomenon.

One technique for manufacturing high strength parts is a method in which instead of carrying out press forming of a high strength steel sheet, press forming is carried out in a low strength state, and quench hardening is carried out after press forming in order to increase the strength of the steel sheet. In this method, the steel composition of the steel sheet is selected so that hardening can be achieved.

Another technique is hot press forming in which a steel sheet is heated and then subjected to press forming. In hot press forming, the steel sheet decreases in strength due to heating, so press forming can be carried out without the above-described problems, even with a steel sheet having a relatively high strength at room temperature.

It is possible to combine hot press forming with hardening so as to obtain a part with even higher strength. Thus, after a steel sheet having a steel composition capable of hardening is heated to a temperature sufficient for hardening, it is subjected to press forming at that temperature and then to quenching for hardening either inside the press die or after the press forming step is finished. As a result, compared to the case in which only hardening or hot press forming is employed, it is possible to manufacture a formed part of even higher strength. Therefore, in hot press forming, hardening is usually performed. If hardening is carried out inside a press die, forming and hardening can be simultaneously achieved without performing heat treatment for the purpose of hardening after press forming. For example, see JP-A 2002-102980.

Since hot press forming is a method in which working is applied to a heated steel sheet, surface oxidation of the steel sheet is unavoidable. Even if a steel sheet is heated in a nonoxidizing atmosphere, while it is being removed from a heating furnace and subjected to pressing, it contacts the air, and iron oxides are formed on the surface of the steel sheet. Moreover, heating in such a nonoxidizing atmosphere increases costs.

Iron oxides which are formed on the surface of a steel sheet may drop off and adhere to a die during pressing, thereby interfering with productivity or making the appearance of a press-formed article poor due to a film made of such iron oxides (referred to below simply as an iron oxide film) remaining on the article. Moreover, if such an iron oxide film remains on a formed article, the iron oxide film has poor adhesion to the surface of the formed article, so if chemical conversion treatment and coating are performed in a subsequent step without removing the iron oxide film, problems occur with respect to coating adhesion, and as a result, corrosion resistance after coating decreases.

As described in claim 6 of JP-A 2003-2058, prior to coating a hot press-formed article, the surface of the formed article is normally cleaned by sandblasting or shot blasting treatment to remove an iron oxide film from the surface. However, such blasting treatment is troublesome, and it greatly decreases the productivity of hot press forming. In addition, it may produce strains in the formed article.

In order to suppress the formation of iron oxides due to oxidation of the surface of a steel sheet during hot press forming and to impart corrosion resistance after forming, it is proposed to apply hot press forming to a steel sheet with a zinc-based plating in JP-A 2001-353548 and JP-A 2003-73774 or to a steel sheet with an aluminum-based plating in JP-A 2000-38640.

However, when an aluminum-plated steel material is hot pressed, when the steel material is heated, mutual diffusion occurs between the plating layer and the steel base material, and Fe—Al or Fe—Al—Si intermetallic compounds are formed in the plating interface. Since these intermetallic compounds are harder than the plating layer at the temperature of hot press forming, they impart damage to the die used for hot press forming at the time of continuous press forming, leading to damage to the appearance of the formed articles.

In addition, in hot press forming of an aluminum-plated steel material, an oxide film of aluminum is formed on the plating surface at the time of heating. The oxide film of aluminum causes problems with respect to coating adhesion when coated, though the problems are not as severe as those caused by an oxide film of iron, and therefore the high level of coating adhesion which is demanded of materials for outer plates and suspensions of automobiles cannot necessarily be achieved. In addition, the oxide film makes it difficult to form a good film by chemical conversion treatment which is widely used as pretreatment before paint coating.

Likewise, in hot press forming of a zinc-based plated steel material, iron-zinc (Fe—Zn) intermetallic compounds may form by mutual diffusion between the plating layer and the steel base metal. These intermetallic compounds are also hard, so they impart damage to a hot press forming die. Alternatively, if the heating is inadequate so that a pure zinc phase remains, since the melting point of zinc is lower than the hot press forming temperature, there are cases in which molten zinc is scattered during hot press forming and contaminates the die.

In the hot press forming of a zinc-based plated steel sheet proposed in JP-A 2003-73774, a zinc oxide layer is previously formed on the surface of the zinc-based plating layer by, for example, heating such as one employed in galvannealing finish. The zinc oxide layer on the surface of the plated steel sheet functions as a barrier layer which prevents vaporization of the zinc-based plating layer during hot press forming and during heating prior thereto. However, that publication does not mention anything about the presence of a zinc oxide layer on the surface of a press-formed article formed by hot press forming or the effect thereof. It contains a description that approximately 0.01-5.0 μm is sufficient for the thickness of the oxide film (namely, a zinc oxide layer) which functions as a barrier layer, but this is the thickness of a barrier layer for preventing vaporization of zinc during hot press forming. Therefore, this is the thickness of a zinc oxide layer on the surface of a zinc-based plated steel sheet prior to heating to a hot press forming temperature, and it is not the thickness of a zinc oxide layer on the surface of a formed article obtained by hot press forming.

A hot press-formed article made of a zinc-based plated steel sheet is frequently coated after forming and then used as a part. Such a coated part typically has improved corrosion resistance compared to a part formed by coating a hot press-formed article made from a bare steel sheet.

In the examples of JP-A 2003-73774, the post-coating corrosion resistance of a hot press-formed article made from a zinc-based plated steel sheet is tested. Specifically, the case in which the width of swelling is less than 4 mm in a salt spray test performed for 480 hours is evaluated as "good in post-coating corrosion resistance".

However, the level of post-coating corrosion resistance which is demanded is continually increasing, and depending upon the type of part, the above-described standard for evaluation is inadequate. Examples of parts for which a particularly high post-coating corrosion resistance is demanded are outer panels and suspensions of automobiles.

Accordingly, in the technical field of hot press forming of galvanized and similar zinc-based plated steel sheets, there is a need for a formed article which has good strength as well as good coating adhesion and improved post-coating corrosion resistance when coated and which can be stably manufactured with high productivity. It is also desired that it have a good appearance and that it have good spot weldability, since hot press-formed articles are often assembled or installed by spot welding.

DISCLOSURE OF THE INVENTION

In a first embodiment of the present invention, a hot press-formed article having high strength and improved post-coating corrosion resistance and coating adhesion when coated is characterized by having a zinc-based plating layer including an iron-zinc solid solution phase with a thickness of at least 1 μm and at most 50 μm on the surface of a steel material, and on top thereof, a zinc oxide layer is either substantially not present or is present with an average thickness of at most 2 μm. This hot press-formed article is formed by hot press forming of a zinc-based plated steel material.

The zinc-based plating layer comprising an iron-zinc solid solution phase may consist essentially of an iron-zinc solid solution phase. The total amount of zinc contained in the zinc-based plating layer and the zinc oxide layer on the surface of the steel sheet is preferably at least 10 g/m$^2$ and at most 90 g/m$^2$.

In the hot press forming, the steel material, which is typically a steel sheet, is normally heated to 700-1000° C. and press formed. As a result, a fairly thick oxide film of zinc (namely, a zinc oxide layer) is formed on the surface of a formed article obtained by hot press forming of a zinc-based plated steel sheet. It was found that this thick oxide film which is formed during hot press forming has an adverse effect on post-coating corrosion resistance.

During actual hot press forming operation, there are cases in which the sebum (grease from the skin) or sweat from the operator adheres to the surface of the steel sheet before pressing. If hot press forming is performed in this state and coating is then carried out, the coating adhesion in portions where sebum or sweat adheres locally becomes extremely poor. At this time, the thickness of the oxide film formed after press forming in portions where sebum or sweat adheres becomes significantly greater than in other portions.

By completely removing the zinc oxide layer which is formed on the surface of the hot press-formed article made from a zinc-based plated steel sheet or reducing the average thickness thereof to at most 2 μm by treatment such as shot blasting, the coating adhesion of the hot press-formed article can be improved in a stable manner, and as a result, the corrosion resistance after coating also becomes good.

A hot press-formed article according to the first embodiment can be manufactured by a method comprising a step of hot press forming a plated steel sheet having a zinc-based plating, and subsequently a step of removing all or a portion of a zinc oxide layer formed on the resulting press-formed article so that the average thickness of the zinc oxide layer is at most 2 μm. The step of hot press forming is carried out such that the resulting formed article has a zinc-based plating layer comprising an iron-zinc solid solution layer, and a zinc oxide layer (an oxide film) atop it.

The step of removing the zinc oxide layer may be performed by shot blasting and/or liquid honing. When it is performed by the shot blasting method, steel balls having an average diameter of 100-500 μm are preferably used as shot.

In a second embodiment of the present invention, a hot press-formed article having high strength, good appearance, improved post-coating corrosion resistance and coating adhesion, and good weldability is characterized by having a zinc oxide layer as an uppermost layer and having below it an iron-zinc solid solution layer consisting essentially of an iron-zinc solid solution phase and not having a layer containing a substantial amount of an iron-zinc intermetallic compound. The average thickness of the zinc oxide layer is at most 5 μm. The average thickness of the iron-zinc solid solution layer is preferably 10-40 μm. The total amount of Al contained in the iron-zinc solid solution layer and the zinc oxide layer is at most 0.5 g/m$^2$, or the total amount of aluminum oxides contained in these layers is at most 5 mg/m$^2$ as Al.

A hot press-formed article according to the second embodiment can be manufactured by a method comprising a step of heating a steel material to a predetermined temperature, and a step of press forming the steel material in a high temperature state following the heating step. The steel material is (1) a hot-dip galvanized steel material or a galvannealed steel material with an Al content in the plating of at most 0.35 mass %, or (2) a steel material having an electrogalvanized plating (electroplating with zinc) or an electroplated Zn—Fe alloy plating with a Fe content in the plating of at most 20 mass %. The coating weight of the plating on these plated steel materials is at least 40 g/m$^2$ and at most 80 g/m$^2$. In the heating step, after the steel material is heated in an oxidizing atmosphere from room temperature to a temperature range of 850-950° C. at an average rate of temperature rise of at most 15° C. per second, it is held in this temperature range for at least 30 seconds, with the total of the time for increasing the temperature and the holding time being at least 3 minutes and at most 10 minutes. In the press forming step, the heated steel material is subjected to press forming in a temperature range of 700-950° C.

A hot press-formed article according to the second embodiment is covered by a zinc oxide layer as an uppermost layer and beneath it an iron-zinc solid solution layer consisting essentially of an iron-zinc solid solution phase, and therefore it has excellent corrosion resistance. In addition, the zinc oxide layer which forms the surface layer has excellent adhesion, so it does not readily peel off during press forming. Due to the absence of a layer containing a hard iron-zinc intermetallic compound phase, damage to dies does not readily occur, and the formed article has a good appearance. When coated, the formed article has improved coating adhesion and post-coating corrosion resistance. In addition, the press-formed article can be stably manufactured with high productivity.

DESCRIPTION OF EMBODIMENTS OF THE INVENTION

Figure 1:
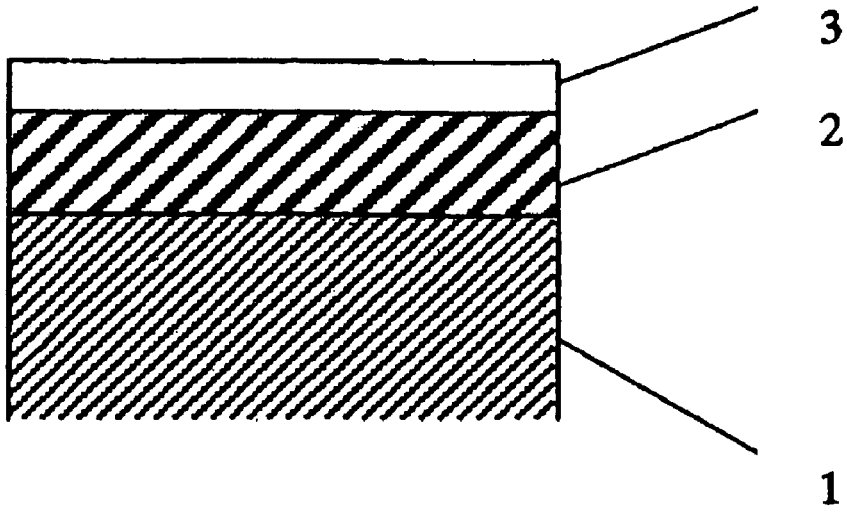
FIG. 1 is a schematic view showing the vicinity of the surface of a hot press-formed article according to the second embodiment of the present invention.

Below, the present invention will be described in detail for the case in which a steel material is a steel sheet. However, hot press forming can be carried out on members other than on a steel sheet such as bars, wires, and pipes by bending, drawing, and the like. Accordingly, the steel material according to the present invention is not restricted to a steel sheet. In the following explanation, unless otherwise specified, percent refers to mass percent.

First Embodiment

In a hot press-formed article according to a first embodiment of the present invention, an iron-zinc solid solution phase exists on the surface of a steel sheet. This solid solution phase may constitute substantially the entirety of a plating layer.

In the context of the present invention, an iron-zinc solid solution phase has a crystal structure which is the same as the α-Fe of the base metal, but it is a phase which has a larger lattice constant and in which incorporation of zinc into iron occurs. The presence of this phase can be ascertained by combined use of an X-ray diffraction apparatus and an elemental analyzer such as an X-ray microanalyzer (referred to as EPMA or XMA).

If a zinc-based plated steel sheet is heated, zinc in the plating layer and iron in the underlying steel sheet undergo mutual diffusion, and an iron-zinc intermetallic compound phase is initially formed in the plating layer. As the mutual diffusion progresses as the heating temperature increases and/or the heating time increases, the iron-zinc intermetallic compound gradually changes to a solid solution. As a result, ultimately, the intermetallic compound phase disappears, and the zinc-based plating layer comes to consist essentially of an iron-zinc solid solution phase.

An intermetallic compound phase may partially remain in a zinc-based plating layer of a hot press-formed article according to the first embodiment, but preferably the zinc-based plating layer consists essentially of an iron-zinc solid solution phase.

The zinc-based plating layer which contains the iron-zinc solid solution phase has a hardness close to that of the steel sheet, so if an iron-zinc solid solution phase is formed during the heating prior to hot press forming, good press formability is obtained.

The zinc content of the zinc-based plating layer containing the iron-zinc solid solution phase is preferably at least 5% and more preferably at least 10%. If the zinc content of the plating layer is too low, the corrosion resistance of the plating layer becomes inadequate, and as a result, the post-coating corrosion resistance of the hot press-formed article decreases.

The thickness of the zinc-based plating layer containing the iron-zinc solid solution phase is at least 1 μm. If the thickness of this plating layer is less than 1 μm, the corrosion resistance is inadequate. On the other hand, if it is too thick, there is a tendency for weldability to decrease, so from a practical standpoint, the upper limit is 50 μm. The thickness of the zinc-based plating layer is preferably 5-25 μm.

As stated above, oxidation of the surface of a steel sheet is unavoidable in industrial hot press forming, so the resulting formed article normally has an oxide film of zinc, i.e., a zinc oxide layer on the surface of the zinc-based plating comprising an iron-zinc solid solution phase. In a manufacturing method for a hot press-formed article according to the first embodiment, as described below, by carrying out treatment to remove the zinc oxide layer from the formed article, a zinc oxide layer atop the zinc-based plating, most preferably, is substantially not present, or even if it is present, the average thickness thereof is at most 2 μm. This is because if the average thickness exceeds 2 μm, the adhesion of the zinc oxide layer itself decreases, and when coated, the coating adhesion becomes inadequate and the post-coating corrosion resistance deteriorates. The thickness of the zinc oxide layer is preferably at most 1 μm and more preferably at most 0.5 μm. The thickness of the zinc oxide layer can be measured by microscopic observation of a cross section of the formed article (under an optical or electron microscope).

It is actually difficult to completely remove the zinc oxide layer. Even if the zinc oxide layer which is formed as an upper layer during hot press forming is completely removed, zinc readily oxidizes, and when kept in air, the zinc in a zinc-based plating containing an iron-zinc solid solution phase oxidizes, so an extremely thin zinc oxide layer (on the order of nanometers) always remains. However, if the zinc oxide layer is of this extent, it does not cause substantial problems with respect to performance. A condition in which "a zinc oxide layer is substantially not present" includes the case in which such an extremely thin oxide film is present. There are cases in which a zinc oxide layer includes not only zinc oxide but also includes hydroxides of zinc or oxides of aluminum or other elements present in the plating. In the present invention, a zinc oxide layer includes the case in which components other than zinc oxide are present.

The total amount of zinc contained in the zinc-based plating layer comprising the iron-zinc solid solution phase and the zinc oxide layer can be determined based on the desired level of corrosion resistance, but a preferred range is 10-90 $g/m^2$. If the total amount of zinc is less than 10 $g/m^2$, corrosion resistance becomes inadequate, whereas if it exceeds 90 $g/m^2$, weldability deteriorates. The total amount of zinc is more preferably in the range of 45-70 $g/m^2$. When calculating the coating weight of these layers, it is thought that the area of a flat plate after forming is not much different from the area of the flat plate prior to forming, so in the present invention, the value found using the area of a flat plate prior to forming is used.

There are no particular limitations on the composition of the base material steel sheet in the present invention. The steel composition can be selected so that the wettability at the time of hot-dip galvanizing and the plating adhesion after plating are good. One of the characteristics of hot press forming is that hardening can be utilized to obtain an increase in strength, so a steel having hardenability is preferred. From the standpoint of hot press forming facilitating press working of a high strength steel, a high tensile strength steel is preferred.

Assuming that hardening is performed during the hot press forming step, the strength of a steel sheet after hardening primarily depends on the carbon content, so when a high strength formed article is necessary, the C content is preferably at least 0.1% and at most 3%. If the C content exceeds this upper limit, there is the possibility of the toughness decreasing.

When using a steel having problems with respect to wettability by molten zinc such as a high Si steel, pretreatment for increasing plating adhesion such as surface grinding or undercoat plating can be performed.

As described below, in the present invention, a galvannealed steel sheet is preferably used as a plated steel sheet. Therefore, a steel having a low P content is preferred so that alloying of iron and zinc can be achieved by heating in a short length of time after plating. When galvannealing treatment is performed in a continuous plating line, the P content is preferably at most 0.2%.

A hot press-formed article according to the first embodiment of the present invention can be manufactured by the method described below.

A zinc-based plated steel sheet used in hot press forming has a zinc-based plating film provided atop a base material steel sheet. There are no particular restrictions on the type of zinc-based plating film as long as a hot press-formed article according to the first embodiment can be obtained. Namely, it may be a pure zinc plating film or it may be a zinc alloy plating film to which alloying elements such as Mn, Ni, Cr, Co, Mg, Sn, and Pb are suitably added in accordance with the objective. There are cases in which the zinc-based plating film contains Be, B, Si, P, S, Ti, V, W, Mo, Sb, Cd, Nb, Cu, Sr, and the like which are unavoidable in the raw materials.

Preferred zinc-based plating films are plating films of a zinc alloy such as zinc-iron, zinc-nickel, zinc-cobalt, zinc-chromium, or zinc-manganese alloy. This is because these zinc alloy plating films have a higher melting point than a pure zinc is plating film, so it is difficult for the zinc in the plating films to vaporize during hot press forming.

The zinc-based plating film is preferably formed by hot-dip plating, but it is possible to form it by other plating methods, such as electroplating.

From the standpoints of cost and performance, the most preferred zinc-based plated steel sheet is a galvannealed steel sheet, which is a hot-dip galvanized steel sheet to which heat treatment is applied after galvanizing so as to form an alloy (solid solution) between the Fe in the steel sheet and the Zn in the plating layer. If the heat treatment for alloying after galvanizing is carried out such that the plating film has a relatively high iron content of at least 10%, an adequate amount of an iron-zinc solid solution phase can be formed by heating for a relative short length of time prior to press forming, which is advantageous from a practical standpoint.

Al is normally is present in a hot-dip galvanizing bath, so the plating film also contains Al. No particular problems will occur if the Al content of the plating film is at most approximately 0.5%. However, in order to make the iron content in the plating film at least 10% by the alloying during heat treatment after galvanizing, it is advantageous for the Al content to have a low value of approximately at most 0.4%.

Taking into consideration the vaporization of zinc in the below-described heating step and the decrease thereof in the oxide film-removing step, it is sufficient for the final coating weight of the plating to be at least 10 g/m$^2$ as zinc on the surface of the press-formed article. Specifically, it should be selected based on the level of corrosion resistance necessary for the location in which the formed article is to be used. For example, with automotive parts requiring a high level of corrosion resistance, the coating weight per side of the plating film is preferably at least 50 g/m$^2$ as zinc.

Hot press forming is carried out on a zinc-based plated steel sheet which is prepared in this manner. There are no particular restrictions on the heating method used for hot press forming, but normally heating is carried out in a gas furnace or an electric furnace. There are no restrictions on the heating atmosphere, but air is sufficient.

As a result of this heating, a portion of the zinc contained in the plating film vaporizes or it becomes a zinc oxide layer present in the upper portion, and all or a portion of the remainder diffuses into the steel base material and forms a zinc-based plating layer comprising an iron-zinc solid solution phase. The thickness of the zinc oxide layer depends on the heating conditions, but in normal heating in air, it is mostly at least 3 μm. At the time of heating, the atmosphere may be adjusted when it is desired to actively control the thickness of the zinc oxide layer which is formed. For example, in the case of a gas furnace, the average thickness of the oxide film can be reduced by setting the oxygen concentration of the atmosphere to a relatively low level by adjusting the air-fuel ratio.

The temperature of the material at the time of hot press forming is normally approximately 700-1000° C. Accordingly, the furnace temperature can be set to approximately 700-1000° C. If the heating temperature of the material is too high, the thickness of the solid solution phase and the oxide film layer become too large, and there are cases in which weldability deteriorates, the adhesion of the zinc oxide layer deteriorates, or the coating adhesion becomes poor. On the other hand, if the heating temperature is too low, in some materials, softening may be inadequate so that an excessive pressing force is required during hot press forming, and this becomes the cause of the occurrence of flaws in the surface of the steel sheet or fracture of the steel sheet.

In the case of a hardenable steel, its hardenability depends on the cooling rate, and it is necessary to cool a material, which has been heated to a predetermined temperature, by a sufficient cooling rate. Accordingly, if the heating temperature of the material is not higher than a certain temperature, the sufficient cooling rate cannot be guaranteed. From this standpoint, a particularly preferred heating condition is that the furnace temperature be set so that the material temperature reaches 800-900° C.

There is no particular restriction on the heating time, but there exists an optimal value for it so as to control the thickness of the solid solution phase and the zinc oxide layer to target values. If the heating time is extremely short such as on the order of a few seconds, the formation of an iron-zinc solid solution phase by mutual diffusion of Zn in the zinc-based plating film and Fe in the base metal becomes inadequate. Conversely, if the heating time becomes a long value exceeding 10 minutes, depending upon the furnace atmosphere, the thickness of the zinc oxide layer may become too great. Naturally, a long heating time is also not desirable from the standpoint of energy loss. A preferred heating time is on the order of 4-7 minutes.

Press forming is carried out immediately after heating. The forming method at this time may be the same as for usual press forming. In general, it is preferable for the temperature of the material at the time of hot press forming to be at least 700° C. This temperature can be adjusted in accordance with the thickness and strength of the material and the formed shape. It is preferable for the heated material to be transported to the press as quickly as possible, set therein, and then press formed.

Then, cooling is performed immediately after forming by hot press forming. There is no particular restriction on the cooling method, but when hardening is performed, cooling is carried out so as to guarantee a cooling rate sufficient for hardening. For this purpose, it is effective to incorporate a water cooling mechanism into the press die. It is possible to use either a direct water cooling method in which water is directly applied to the material or an indirect water cooling method in which the interior of a die is water cooled. There is a small difference in the thickness and structure of the zinc oxide layer formed on the surface of the material depending on whether water is directly applied to the surface or not, but an average thickness of at most 2 μm which is the thickness of the zinc oxide layer according to the first embodiment, can be achieved by either method.

When heating and cooling are carried out under the normal conditions for hot press forming, a zinc oxide layer typically having a thickness of at least 3 μm is formed on the surface of the hot press-formed article. The presence of such a thick zinc oxide layer decreases coating adhesion and post-coating corrosion resistance when the formed article is subsequently coated, so removal thereof is performed.

It is possible to regulate the thickness of the zinc oxide layer which is formed on the surface of the formed article to at most 2 μm according to the first embodiment by adjusting the plating composition used for plating prior to hot press forming and adjusting conditions such as the heating and cooling atmosphere used in hot press forming. However, for this purpose, it becomes necessary to perform strict control of each of these conditions. Accordingly, from an industrial standpoint, it is more convenient and reliable to remove the top layer which is the zinc oxide layer by some means after hot press forming.

The zinc oxide layer can be removed from the surface by any suitable method. For example, removal can be carried out by shot blasting in which minute steel spheres are shot at a high speed at the surface of a steel sheet, liquid honing in which a liquid containing a cleaning abrasive is ejected at high pressure toward the surface of the steel sheet, surface grinding with a grinding brush, or sanding with sandpaper. Shot blasting and liquid honing are preferred as methods for uniformly processing the surface of a formed article having a complicated shape. When it is attempted to remove an oxide film from the top of a plating layer with sandpaper, there is a tendency to remove too much material. Shot blasting is superior from this standpoint as well.

Shot blasting is also referred to as shot peening. This is typically a method in which surface dirt and rust and the like are removed by shooting steel spheres having a diameter of several hundred micrometers at the surface by centrifugal force or pneumatic pressure. In the present invention, steel spheres are preferably used as shot. In general, for the purpose of removing rust, an angular shot called grit which is made of crushed pieces of steel or finely cut pieces of wire are employed. However, in the present invention, it is sufficient to primarily remove only an excess amount of the zinc oxide layer from the surface, and it is preferable, as much as possible, not to damage the underlying zinc-based plating layer comprising an iron-zinc solid solution phase. When grit is used, as shown in the below-described examples, it is easy to damage the zinc-based plating layer when removing the zinc oxide layer, so setting the conditions is quite difficult. Accordingly, the shot is preferably spherical, and its hardness is preferably about that of steel.

The shot blasting conditions can be suitably adjusted in accordance with the shape of the formed article and the state of surface oxidation. In general, when treating a formed article, the distance over which shot is propelled is longer than for a flat plate shape, so in order to prevent an attenuation of the shooting energy and obtain a good effect from shot, an impeller type shooting apparatus is preferably employed. In the case of a formed article having a flat plate shape or a small size, it is also possible to use a pneumatic air blasting apparatus. If the steel spheres are too small, their film removing ability decreases due to energy attenuation, so it is preferable to use steel spheres having an average particle diameter on the order of 100-500 μm. It is sufficient for the duration of shot blasting measured as the length of time for which a shot pattern hits a prescribed region to be roughly from several seconds to around 30 seconds.

Liquid honing is a method in which water containing a cleaning abrasive such as silica particles is ejected at a high pressure of at least 100 MPa. As is the case with shot blasting, it is possible to remove only the upper zinc oxide layer without substantially damaging the underlying base metal or zinc-based plating layer. Since water is used, there is the possibility of rust developing particularly at end surfaces, so adequate drying is carried out after treatment.

Both shot blasting and liquid honing have the effect of not only removing the top zinc oxide layer but of removing iron scale which occurs at end surfaces.

Second Embodiment

Figure 2:
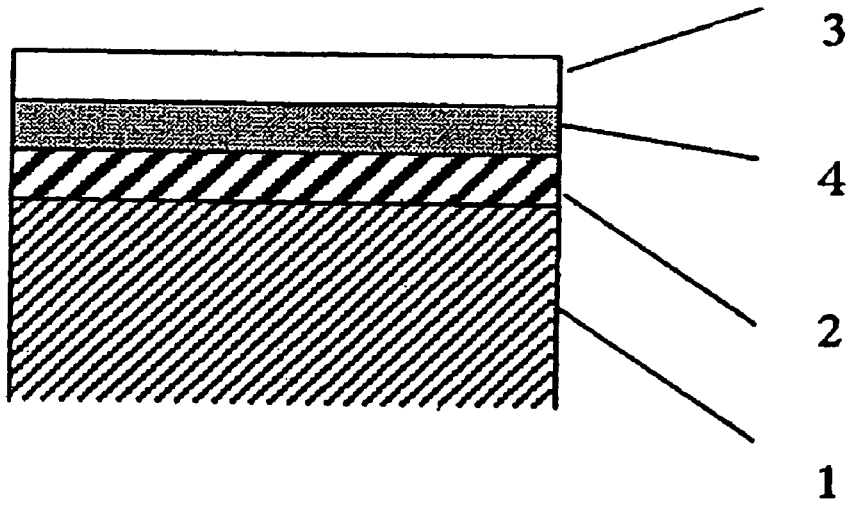
Fig. 2 PRIOR ART
FIG. 2 is a schematic view showing the vicinity of the surface of a typical conventional hot press-formed article.

As schematically shown in FIG. 1, a hot press-formed article according to a second embodiment of the present invention has a surface structure which includes an iron-zinc solid solution layer (referred to below simply as a solid solution layer), shown by reference number 2 which is located in the vicinity of the surface and which consists essentially of an iron-zinc solid solution phase, and on top of this layer, a zinc oxide layer 3 which forms a surface layer. Namely, a lower iron-zinc solid solution layer 2 and an upper zinc oxide layer 3 are consecutively formed on a base metal steel 1. It is different from a typical surface structure like that shown in FIG. 2 in which a layer 4 containing a substantial amount of an iron-zinc intermetallic compound is present between an iron-zinc solid solution layer 2 and a zinc oxide layer 3. The iron-zinc solid solution layer 2 and the zinc oxide layer 3 can be formed by heating a zinc-based plated steel sheet in an oxidizing atmosphere.

In the present invention, the iron-zinc solid solution phase has the same α-Fe crystal structure as the base metal, but it is a phase which has a larger lattice constant and in which incorporation of zinc into iron occurs. The presence and thickness of the iron-zinc solid solution layer consisting essentially of this iron-zinc solid solution phase can be ascertained by the combined use of an X-ray diffraction apparatus and an elemental analyzer such as an X-ray microanalyzer (EPMA or XMA). The iron-zinc solid solution layer has a hardness close to that of a steel sheet, so unlike a Fe—Zn intermetallic compound, it is difficult for it to damage a die, so flaws in the appearance of a formed article due to die damage can be avoided.

The thickness of the iron-zinc solid solution layer is preferably in the range of 10-40 μm. If the thickness of the solid solution layer is smaller than 10 μm, the corrosion resistance is inadequate, while if it exceeds 40 μm, weldability becomes inadequate. The zinc content of the iron-zinc solid solution layer is preferably at least 5%. The thickness of the iron-zinc solid solution layer is more preferably 15-35 μm. A method of measuring the thickness will be explained in the examples.

In a hot press-formed article according to the second embodiment of the present invention, an intermetallic compound phase is not present in the vicinity of the surface of a steel sheet. An intermetallic compound is, for example, a δ1 phase or Γ phase or similar iron-zinc intermetallic compound which is observed in a plating film of a galvannealed steel sheet. An intermetallic compound has a high hardness, so it can easily damage a die during press forming. In addition, when the degree of working applied by press forming is high, there are cases in which cracks form in the intermetallic compound phase, thereby decreasing the adhesion of the surface layers or deteriorating the surface appearance after coating. The absence of an intermetallic compound phase can be ascertained by microscopic observation of the structure.

Namely, in this hot press-formed article, an iron-zinc intermetallic compound phase, which is seen in the plating film of a galvannealed steel sheet, has disappeared. Of course, there is also no pure zinc phase. The disappearance of these phases may be achieved while the material is being heated in the heating step and in the subsequent pressing step to perform hot press forming. Accordingly, in the steel sheet prior to hot press forming, an intermetallic compound phase and a pure zinc phase may be present.

The corrosion resistance of a press-formed article is guaranteed by the zinc oxide layer on the surface and the iron-zinc solid solution layer present immediately beneath it (without the above-described intermetallic compound phase being present between them). However, if the zinc oxide layer becomes too thick, the adhesion of the zinc oxide layer itself worsens and the coating adhesion when coated becomes inadequate, and weldability decreases. Therefore, the average thickness of the zinc oxide layer is made at most 5 μm. There is no particular lower limit on the thickness of the zinc oxide layer. As described below, when a zinc-based plated steel sheet is subjected to hot press forming in an oxidizing atmosphere, the thickness of the zinc oxide layer mostly becomes at least 3 μm. However, the thickness of the zinc oxide layer may be less than 3 μm. For example, it may have a small value such as 0.1 μm.

There are cases in which the zinc oxide layer includes not only zinc oxide but also other zinc compounds such as hydroxides of zinc and oxides of elements such as Al present in the plating. In the present invention, the zinc oxide layer includes such cases. The thickness of the zinc oxide layer can be measured by microscopic observation of a cross section of the formed article (using an optical or electron microscope).

Since a small amount of Al is normally added to a hot-dip galvanizing bath, the plating film of a hot-dip galvanized steel sheet (including a galvannealed steel sheet, for example) contains a small amount of Al. Accordingly, in an article made from such a steel sheet by hot press-forming, Al is contained in the iron-zinc solid solution layer and the zinc oxide layer. Furthermore, the steel base metal typically contains a minute amount of Al, so there is the possibility of Al diffusing from the steel base metal.

In a hot press-formed article according to the second embodiment, the total amount of Al contained in the zinc oxide layer and the solid solution layer is at most 0.5 $g/m^2$ and preferably at most 0.45 $g/m^2$. Al can be present as an intermetallic compound and a metal, and, in addition, it may also be present in the form of an Al oxide. The total amount of Al oxides present in the zinc oxide layer and the solid solution layer is at most 5 $mg/m^2$ and preferably at most 3 $mg/m^2$ as Al.

If the total content of Al and the total content of Al oxides as Al exceed the above-described upper limits, the coating adhesion when coated becomes inadequate. A correlation can be seen between the Al content and the Al oxide content, so it is possible to measure just the total content of Al or the total content of Al oxides as Al and to determine whether or not a hot press-formed article having good coating adhesion according to the second embodiment is obtained. However, preferably both the total Al content and the total content of Al oxides as Al satisfy the conditions prescribed in the second embodiment.

It is not clear why the content of Al or Al oxides has an adverse effect on coating adhesion. However, it is thought that if the amount of Al or Al oxides becomes too large, they tend to be concentrated at the interface between the zinc oxide layer and the solid solution layer of the hot press-formed article and obstruct adhesion of the zinc oxide layer and have an adverse effect on the coating adhesion of the formed article.

The content of Al and Al oxides can be determined by immersing a sample of the press-formed article having a measured surface area in hydrochloric acid and in an aqueous chromic acid solution (having a concentration on the order of 5-10%, for example) to dissolve the plated film (the zinc oxide layer and the solid solution layer), and measuring the amount of Al in the resulting solutions. Hydrochloric acid dissolves Al and Zn in the form of both a metal (including an intermetallic compound) and an oxide, but a chromic acid solution does not dissolve Al and Zn in the form of a metal. Accordingly, just oxides of Al and Zn can be dissolved by immersing a sample in an aqueous 5% chromic acid (chromium trioxide) solution for around 10 minutes, for example. It is convenient to determine the amount of Al in the solution using an instrumental analysis method such as ICP (inductively coupled plasma) emission spectrometry or atomic absorption spectrometry.

As described above, the amount of Al and the amount of Al oxides vary depending on both the amount of Al in the plating film and the amount of Al in the steel, but the effect of the amount of Al in the plating film is particularly large. Accordingly, when the material being worked is manufactured by hot-dip galvanizing, it is important to control the amount of Al in the plating film. This point will be described below in connection with a manufacturing method. In the case of electrogalvanizing (zinc electroplating) or zinc-iron alloy electroplating, since the plating film contains substantially no Al, only diffusion of Al from the steel occurs. However, this diffusion is normally of a minute amount which does not cause a problem, so there is no particular need to take measures concerning it.

In the second embodiment, there is no particular restriction on the composition of the base metal steel sheet of the hot press-formed article. A suitable composition can be determined taking into consideration the use and the manufacturing method of the press-formed article.

For example, as stated above, when it is desired to obtain a high strength formed article by increasing the strength by hardening during the hot press forming step, since the strength of a steel sheet after hardening is primarily governed by the carbon content, the carbon content is preferably at least 0.1% and at most 3%. If the carbon content is higher than 3%, there is the possibility of a decrease in toughness. In addition to C, it is possible to add to the steel a suitable amount of one or more other alloying elements (such as Mn, Cr, and B) known to increase hardenability.

When the base material steel sheet is plated by hot-dip galvanizing, it is necessary for it to have sufficient wettability by molten zinc. In the case of a steel such as a high Si steel having problems with respect to wettability in such plating, the adhesion can be improved by surface grinding or undercoat plating. Accordingly, in FIG. 1, an undercoat plating layer or a solid solution layer formed therefrom by heat treatment may be present between the base material steel sheet 1 and the iron-zinc solid solution layer 2. However, the formation of intermetallic compounds is not desirable since it offers a lot of problems.

When a galvannealed steel sheet is used as a plated steel sheet, a steel sheet having a low P is preferred so that iron-zinc alloying can be achieved in a short period of time by heat treatment after plating. When galvannealing heat treatment of a zinc plating film is carried out in a continuous plating line, the P content is preferably at most 0.2%.

A hot press-formed article according to the second embodiment has excellent coating adhesion, so it is useful in applications in which the article is coated after press forming. However, depending upon the location of the article, it may also be used without coating.

A hot press-formed article according to the second embodiment of the present invention can be manufactured by a method including a heating step in which a steel sheet to be worked is heated under predetermined conditions, and a pressing step in which the steel sheet is then pressed at a high temperature.

There are no particular restrictions on a steel sheet to be subjected to working as long as the vicinity of the surface of the hot press-formed article which is finally manufactured by the heating step and the subsequent pressing step at a high temperature has the above-described structure. However, preferably it is a zinc-based plated steel sheet as described below.

The coating weight per side of the plated film of the zinc-based plated steel sheet is at least 40 g/m$^2$ and at most 80 g/m$^2$. If the coating weight is too small, in the corrosion resistance may not reach the desired level for products for use in some locations. In addition, in the case of pure zinc plating, in the heating step at the time of hot press forming, it may become difficult to form a solid solution layer, resulting in the formation of a thick oxide film or causing intermetallic compounds to remain. If the plating weight exceeds 80 g/m$^2$, since the zinc in the plating film cannot be sufficiently diffused to form a solid solution during normal heating for hot press forming, there is the possibility of iron-zinc intermetallic compounds such as r phase and metallic zinc remaining. If intermetallic compounds remain, the surface of the steel sheet becomes hard, and not only do problems develop with respect to formability at the time of pressing, but the hardness causes damage to dies, leading to a decrease in the lifespan of dies and a deterioration in the appearance of the formed article. The coating weight of plating is preferably at least 50 g/m$^2$ and at most 70 g/m$^2$.

In order to obtain such a zinc-based plated steel sheet having a relatively large coating weight, hot-dip plating is more advantageous than electroplating from a cost standpoint. In addition, a galvannealed steel sheet is more suitable than a simple hot-dip galvanized steel sheet for use in the second embodiment. This is because with a galvannealed steel sheet, at the time of heating in hot press forming, mutual diffusion between iron and zinc rapidly progresses, and it becomes easier to obtain a formed article in which an iron-zinc intermetallic compound phase does not exist. However, if a surface structure comprising a zinc oxide layer and an iron-zinc solid solution layer as prescribed by the present invention can be formed, a hot-dip galvanized steel sheet can also be used as a material to be subjected to working.

As described above, a hot-dip galvanized steel sheet (including a galvannealed steel sheet) normally contains a small amount of Al in the plating film. This is because approximately 0.1-0.2% of Al is normally added to a plating bath in order to suppress iron-zinc diffusion in the interface between the plating and the steel base metal and in order to control the amount of dross in the plating bath. As described above, if the amount of Al (or the amount of Al oxides) contained in the iron-zinc solid solution layer and the oxide film (the zinc oxide layer) of the formed article is excessive, it has an adverse effect on the coating adhesion of the formed article when coated. For this reason, the Al content of the plating film of a hot-dip galvanized steel sheet or a galvannealed steel sheet is made at most 0.35%.

When using a galvannealed steel sheet as a material for hot press forming, it is preferable to use one having a relatively high Fe content in the plating film. This is in order, as described above, to cause an intermetallic compound phase to disappear by heating in a relatively short length of time and to form a surface layer structure made entirely of a zinc oxide film and an iron-zinc solid solution layer beneath it. However, if it is attempted to excessively increase the Fe content of a plating film, in some cases, it is necessary to enormously decrease the line speed of a hot-dip plating line, which is not practical. A preferred range for the Fe content of the plating film is 10-20% and more preferably 10-15%.

Although doing so increases cost, it is also possible to use an electroplated steel sheet as a material to be worked by hot press forming. An electroplated steel sheet has the advantage that the plating film normally does not contain Al. The electroplated steel sheet may be a popular electrogalvanized steel sheet having a pure zinc plating, but a steel sheet with an iron-zinc (Fe—Zn) alloy plating (with a Fe content of at most 20% in the plating film) is preferred. A Fe—Zn alloy electroplated steel sheet has not only the advantage that it does not contain Al, but like a galvannealed steel sheet, it has the additional advantages that a solid solution layer is formed in a relatively short period of heating, and an intermetallic compound can be prevented from remaining.

There is no particular restriction on a heating method in the heating step of hot press forming. Normally, a gas furnace or an electric furnace is used, and a material to be worked, which is a zinc-based plated steel sheet, is heated in an oxidizing atmosphere. Air may be used as an oxidizing atmosphere, but a mixed gas of air and/or oxygen and another gas (such as nitrogen or a combustion gas) may also be used.

During this heating, a portion of the zinc contained in the plating film vaporizes or forms a zinc oxide layer in the top portion of the film, and the remainder diffuses into the steel base material and is completely dissolved in iron to form a solid solution. As a result, an upper zinc oxide layer and a lower iron-zinc solid solution layer are formed from the plating film without leaving an intermetallic compound phase.

The thickness of the zinc oxide layer depends on the heating conditions, but with normal heating in air, it often becomes at least 3 μm. When it is desired to actively control the thickness of the zinc oxide layer (the oxide film) formed during heating, the heating atmosphere may be adjusted. For example, in the case of a gas furnace, the average film thickness of an oxide film can be reduced by setting the oxygen concentration to a relatively low level by adjusting the air-fuel ratio.

The temperature of the material during hot press forming is normally approximately 700-1000° C., and the furnace temperature is normally about the same temperature. If the heating temperature of the material is too high, the film thickness of the solid solution layer and the oxide film may become too large, thereby decreasing weldability or decreasing the adhesion of the zinc oxide film which makes the coating adhesion inferior when coated. On the other hand, if the heating temperature is too low, in some materials, softening of the material may become inadequate so that an excessive pressing force is required at the time of hot press forming, and this may lead to the occurrence of flaws in the surface of the material or fracture of the material.

In the case of a hardenable steel, its hardenability depends on the cooling rate, and it is necessary to cool a material, which has been heated to a predetermined temperature, by a sufficient cooling rate. Accordingly, if the heating temperature of the material is not higher than a certain temperature, the sufficient cooling rate cannot be guaranteed.

In the second embodiment, it is necessary to diffuse zinc into the steel base material by the heating performed in the heating step so that an intermetallic compound phase disappears and does not remain. For this purpose, it is advantageous for the heating temperature of the material to be relatively high. From the above standpoint, the heating temperature of the material in the second embodiment is made to be in the range of 850-950° C.

From the standpoint of making the intermetallic compound phase disappear and controlling the thickness of the solid solution layer and the zinc oxide layer, in addition to the above-described temperature, the heating time and the rate of temperature rise are also important as heating conditions. If the heating time is extremely short such as a few seconds, it is difficult to sufficiently form an iron-zinc solid solution layer formed by mutual diffusion between the zinc-based plating film and the base metal. If a steel sheet at room temperature is heated in an electric furnace or a gas furnace, when the heating time (the total time of the below-described time for temperature increase and holding time) is at most 3 minutes, it is difficult to achieve the film structure shown in FIG. 1 in which intermetallic compounds have disappeared. However, if the heating time becomes long such as one exceeding 10 minutes, depending upon the furnace atmosphere, there are cases in which the thickness of the zinc oxide layer becomes excessive. Of course, a long heating time is also not desirable from the standpoint of energy losses. Therefore, the heating time is made 3-10 minutes and preferably 4-7 minutes.

An average rate of temperature rise from room temperature to the heating temperature in the range of 850-950° C. is made at most 15° C. per second. If the temperature is increased at a faster rate, there is the possibility of a high hardness film in which iron-zinc intermetallic compounds remain being formed and of the die being worn during hot press forming, or when the plated steel sheet includes a pure is zinc phase having a low melting point in the plating, there is the possibility of scattering of metallic zinc in a liquid state. However, if the rate of temperature rise is set too low, the heating time becomes too long, and the practicality from an industrial standpoint is decreased. A preferred rate of temperature rise is 3-12° C. per second, and more preferably is 4-10° C. per second.

After heating to a temperature in the range of 850-950° C. at a rate of at most 15° C. per second, the temperature is held for a certain length of time. If the holding time in this temperature range is not at least 30 seconds, an intermetallic compound phase may remain.

The pressing conditions in the pressing step may be the same as for usual hot press forming. The material temperature during forming should be adjusted in accordance with the thickness and strength of the material and the shape to be formed, but in general the material temperature at the time of pressing is at least 700° C. Accordingly, a zinc-based plated steel sheet which is previously heated in the above-described manner is preferably promptly transported to a press, set therein, and then subjected to press forming.

There are no particular restrictions on a cooling method during hot press forming and after pressing. However, when hardening is carried out, it is necessary to take some measures in order to guarantee a cooling rate necessary for hardening. For this purpose, it is effective to incorporate a water cooling mechanism into a press die. Either a direct water cooling system in which water is directly applied to a material or an indirect water cooling system in which the interior of a die is water cooled may be used. Depending upon whether water directly contacts the surface of the material or not, there is a slight difference in the thickness and structure of the zinc oxide layer on the surface, but a surface film structure according to the second embodiment can be obtained by either method.

In a method according to the second embodiment, it is not always necessary to perform a step of removing a zinc oxide layer from the surface after hot press forming. However, in cases in which an extremely high coating adhesion when coated is demanded, it is possible to perform a step of removing all or a portion of the zinc oxide layer by shot blasting or liquid honing, although doing so leads to a is decrease in productivity.

This treatment for removing the zinc oxide layer can be lighter treatment than when removing iron oxides in the above-described prior art. For example, in the case of shot blasting, it may be carried out using steel spheres with a diameter of 100-500 μm with an impeller-type apparatus for several seconds to several tens of seconds.

Liquid honing is a method in which water containing a cleaning abrasive such as silica particles is ejected at a high pressure of at least 100 MPa. As is the case with shot blasting, it is possible to remove just the upper zinc oxide layer without imparting any substantial damage to the underlying base metal or the zinc-based plating layer. Due to the use of water, there is the possibility of rust formation particularly on end surfaces, so sufficient drying is performed after treatment.

With either shot blasting or liquid honing, there is the effect not only of removing the upper zinc oxide layer but of removing iron scale formed on end surfaces. Removing the zinc oxide layer with sandpaper has the tendency to remove too much material, so it is not desirable.

EXAMPLES

The following examples are for the purpose of specifically demonstrating the operation and effects of the present invention and should not be interpreted as limiting the present invention.

Example 1

This example illustrates the first embodiment of the present invention.

A galvannealed steel sheet was used as a zinc-based plated steel sheet for hot press forming. It was made by subjecting a base material steel sheet, which was a 2 mm-thick cold rolled steel sheet containing 0.2% C, 0.3% Si, 1.3% Mn, and 0.01% P, to galvanneal-finished hot-dip galvanizing so as to form a plating film having a coating weight of 45-75 g/m$^2$ per side and an iron content of 13-15%. As a comparative example, a cold rolled steel sheet which was not plated was used in Run No. 5 in Table 1.

The zinc-based plated steel sheet prepared in this manner was heated for 3-10 minutes in an air furnace at a temperature of 850-950° C. By varying the heating conditions (the combination of temperature and heating time), test materials for hot press forming which varied with respect to the thickness of a zinc oxide layer, the thickness of an iron-zinc solid solution phase, and the amount of zinc in the solid solution phase were prepared.

After being removed from the furnace, the test materials were immediately cooled for 30 seconds by pressing in a flat plate press having a water cooling jacket in order to simulate hot press forming.

Pneumatic shot blasting treatment was then carried out on one side of each cooled test material to completely or partially remove the upper zinc oxide layer. The air pressure was 2 $kgf/cm^2$, the distance between the nozzle and the test material was 20 mm, and steel spheres having an average diameter of 0.3 mm were used as shot. The degree of shot blasting was adjusted by the duration of shot blasting.

In Run No. 6 of Table 1, shot blasting was not carried out. For No. 8, the zinc oxide layer was removed by the use of sandpaper. As shown in Table 1, with sandpaper, the zinc-based plating layer was completely removed.

The structures of the formed articles obtained in this manner by a method simulating hot press forming were evaluated as follows.

1) Measurement of the Thickness of the Zinc-Based Plating Layer Comprising an Iron-Zinc Solid Solution Phase:

A sample of a cross section of a hot press-formed article was prepared, and the surface on the side which underwent the above-described removal treatment was polished to a mirror finish. X-ray analysis by EPMA was carried out on this test piece with an electron acceleration voltage of 15 kV, a current of 5-10 nA, and a scanning speed of 2-5 μm per minute. Taking into consideration the range of X-rays discharged from the sample, the interface of the iron-zinc solid solution phase with the base metal and that with the Zn—Fe intermetallic compound phase or the zinc oxide layer, these interfaces appearing on the inner side of the Zn—Fe intermetallic compound phase or the zinc oxide layer (on the base metal side), were determined in the following manner.

The interface of the iron-zinc solid solution phase with the steel base metal was determined as follows. It is assumed that in the characteristic X-ray strength of Zn in the iron-zinc solid solution phase, the integrated strength of the tail portion on the side of the steel base metal centered on the position of the ½ strength of the steady-state portion for the iron-zinc solution phase has a normal distribution. Based on this assumption, the strength distribution was converted to a distribution function, and the location of the standard deviation 2σ from the level of significance of a test was determined to be the interface. Similarly, the interface of the iron-zinc solid solution phase on the opposite side (namely, the interface thereof with the intermetallic compound phase or the zinc oxide layer) was determined from the integration strength in the tail portion towards the iron-zinc solid solution phase centered on the position of the ½ strength of the steady-state portion or the maximum portion for the Zn—Fe intermetallic compound phase or the zinc oxide layer. The length between these two interfaces was made the thickness of the iron-zinc solid solution phase.

When an iron-zinc intermetallic compound phase did not exist, the thickness of the iron-zinc solid solution phase determined as above was made the thickness of the zinc-based plating layer. When an iron-zinc intermetallic compound phase was present, the thickness of this phase was determined by observation with an optical microscope, and it was added to the thickness of the above-described iron-zinc solid solution phase, the sum being made the thickness of the zinc-based plating layer.

2) Measuring the Thickness of the Zinc Oxide Layer

The above-described sample of a cross section was observed with an optical microscope, and the thickness of the zinc oxide layer on the surface on the side on which removal treatment of zinc oxide was performed was measured.

3) Total Amount of Zinc in the Plating Layer

The total amount of zinc present in the plating layer was measured in the following manner.

A test piece measuring 10 cm×10 cm was cut from a formed article. The plating layer on the surface opposite from the surface to be measured (on the side on which removal treatment was not performed) was polished with sandpaper so that the zinc-based plating layer (including the iron-zinc solid solution phase) on that side was completely removed. The resulting test piece having the plating layer remaining on just one side was completely dissolved in 10% hydrochloric acid, and the amount of zinc present in the solution was determined.

4) Testing Methods of Properties

Coating Adhesion:

After a formed article was subjected to chemical conversion treatment (using a solution PBL-3080 manufactured by Nihon Parkerizing under the standard conditions for this solution), electrodeposition coating was applied to the surface on the side on which removal treatment had been performed (using a coating composition GT10 manufactured by Kansai Paint with a target film thickness of 20 μm, voltage and conducting pattern: a sloping voltage of 200 volts (from 0 volts to 200 volts in 30 seconds), and baking at 160° C. for 20 minutes).

After this electrocoated material was immersed in deionized water at 40° C. for 500 hours, a cross-cut was made on the coated surface according to the method of cross-cut test described in JIS G3312 12.2.5, and tape peeling was carried out. The percentage of the peeled area of the cross-cut portion (the number of peeled squares out of the 100 squares made by cross cutting) was determined, and coating adhesion was evaluated as acceptable (marked "○") when the percentage was at most 1% and as unacceptable (marked "X") when it exceeded 1%.

Post-Coating Corrosion Resistance:

After X-shaped scratches having a depth reaching the steel base metal were formed with a blade cutter in the coated surface of the electrocoated material, the material was subjected to the salt spray test set forth in JIS Z2371. After 960 hours, the maximum swelled width of the coating from the scratches was determined, and samples for which this width was at most 2 mm were evaluated as acceptable (○), and those for which it exceeded 2 mm were evaluated as unacceptable (X).

The results are shown in Table 1 in which Nos. 1-4 are examples of the present invention.

TABLE 1

| Run No. | Coating weight of plating on steel sheet | Treating method | Zinc-based plating layer Thickness (μm) | Zinc-based plating layer Zinc content (%) | Thickness of zinc oxide layer (μm) | Total amount of zinc ($g/m^2$) | Coating adhesion | Post-coating corrosion resistance |
|---|---|---|---|---|---|---|---|---|
| 1 | 40 | shot | 5 | 15 | 0.5 | 7 | ○ | ○ |
| 2 | 50 | shot | 15 | 20 | 0.5 | 26 | ○ | ○ |
| 3 | 50 | shot | 15 | 20 | 0 | 24 | ○ | ○ |
| 4 | 50 | shot | 20 | 10 | 0 | 16 | ○ | ○ |
| 5 | 40 | shot | 0* | 0 | 0 | 0 | ○ | X |
| 6 | 50 | none | 15 | 20 | 5* | 39 | X | X |
| 7 | 50 | shot | 15 | 20 | 3* | 33 | X | X |
| 8 | 50 | sandpaper | 0* | — | 0 | 0 | ○ | X |

*Conditions outside the range for the present invention.

Example 2

This example illustrates the second embodiment of the present invention.

1) Manufacture of Hot Press-Formed Articles

Plated Steel Sheet to be Worked:

A galvannealed steel sheet (indicated by the symbol GA) was used as a material for working. The galvannealed steel sheet had plating films having a coating weight of 50-65 $g/m^2$ per side and an iron content of 13-15% on a base material steel sheet which was a 2 mm-thick hardenable cold rolled steel sheet containing 0.2% C, 0.3% Si, 1.3% Mn, and 0.01% P.

In addition, an electrogalvanized steel sheet (indicated by the symbol EG, coating weight of 30 or 70 $g/m^2$ per side), an electroplated steel sheet having an iron-zinc (Fe—Zn) alloy plating (indicated by the symbol FZ, plating weight of 45 $g/m^2$ per side and an Fe content in the plating of 15%), and a hot-dip galvanized steel sheet (indicated by the symbol GI, plating weight of 60 $g/m^2$ per side) in which the base material steel sheet was a cold rolled steel sheet having the same chemical composition and plate thickness as described above were also used as a material to be worked. An aluminum plated steel sheet (indicated by the symbol AL with a plating weight of 80 $g/m^2$ per side) was used as a conventional example.

The Al content of the plating film for each of the plated steel sheets GA, GI, and AL having a plating film containing Al was determined by dissolving the plating film and performing ICP emission analysis on the resulting solution. The Fe content of the plating film of plated steel sheets GA and FZ which contained Fe in the plating film and of GI and AL in which iron diffused into the plating film at the time of hot-dip plating was also determined by the same method.

Heating Step:

The above-described plated steel sheets were heated in an electric furnace under the heating conditions shown in Table 2. By changing the heating conditions (the combination of the rate of temperature rise, the heating temperature, and the temperature holding time), samples were prepared which varied with respect to the presence or absence of an intermetallic compound phase, the thickness of a zinc oxide layer, and the thickness of an iron-zinc solid solution layer.

Pressing Step:

After the samples were removed from the furnace, they were promptly pressed into formed articles using a flat plate press having a water cooling jacket in order to simulate press forming. The material temperature at the time of pressing (immediately before) is shown as the temperature at pressing in Table 2. Each sample was kept for 30 seconds in the water cooled press die. As a result, hardening of the base material steel sheet was also achieved at the same time as press forming.

2) Analysis of the Formed Article

Presence or Absence of an Intermetallic Compound Phase and Thickness of a Zinc Oxide Layer:

A sample of a cross section of the hot press-formed article was prepared and polished to a mirror finish. The sample was observed with an optical microscope, and the presence or absence of an intermetallic compound phase and the thickness of a zinc oxide layer were determined.

Thickness of an Iron-Zinc Solid Solution Layer:

A sample of a cross section of the hot press-formed article (polished to a mirror finish) underwent X-ray analysis by EPMA with an electron accelerating voltage of 15 kV, a current of 5-10 nA, and a scanning speed of 2-5 μm per minute. Taking into consideration the range of X-rays discharged from the sample, the interface of an iron-zinc solid solution phase with the steel base metal and that with a Zn—Fe intermetallic compound phase or a zinc oxide layer, these interfaces appearing on the inner side of the Zn—Fe intermetallic compound phase or the zinc oxide layer (on the base metal side), were determined in the following manner.

The interface of the iron-zinc solid solution phase with the steel base metal was determined as follows. It is assumed that in the characteristic X-ray strength of Zn in the iron-zinc solid solution phase, the integrated strength of the tail portion on the side of the steel base metal centered on the position of the ½ strength of the steady-state portion for the iron-zinc solution phase has a normal distribution. Based on this assumption, the strength distribution was converted to a distribution function, and the location of the standard deviation 2σ from the level of significance of a test was determined to be the interface. Similarly, the interface of the iron-zinc solid solution phase on the opposite side (namely, the interface thereof with the intermetallic compound phase or the zinc oxide layer) was determined from the integration strength in the tail portion towards the iron-zinc solid solution phase centered on the position of the ½ strength of the steady-state portion or the maximum portion for the Zn—Fe intermetallic compound phase or the zinc oxide layer. The length between these two interfaces was made the thickness of the iron-zinc solid solution phase.

Amounts of Al and Al Oxides:

Two test pieces having a predetermined area were cut from a hot press-formed article, one test piece was immersed in 10% HCl (containing an inhibitor), the other test piece was immersed in an aqueous 5% $CrO_3$ solution, and the surface layer was dissolved. Based on the dissolved amount of Al in each solution (determined by ICP emission analysis), the amount of Al and the amount of Al oxides were calculated.

3) Test of Properties and Other Evaluation

Cracking of the Plated Film:

The surface of the hot press-formed article was observed with an optical microscope to investigate whether cracks had formed in the plating film on the surface. As stated above, if an intermetallic compound phase is present, cracks easily form in a plating film, and as a result, scratches are easily formed in a die.

Die Scratches:

The press die was visually observed after the pressing step to determine the presence or absence of scratches on the die.

Coating Adhesion:

After a formed article was subjected to chemical conversion treatment (using a solution PBL-3080 manufactured by Nihon Parkerizing under the standard conditions for this solution), electrodeposition coating was performed (using a coating composition GT10 manufactured by Kansai Paint with a target film thickness of 20 μm, voltage and conducting pattern: a sloping voltage of 200 volts (from 0 volts to 200 volts in 30 seconds), and baking at 160° C. for 20 minutes).

After this electrocoated material was immersed in deionized water at 40° C. for 500 hours, a cross-cut was made on the coated surface according to the method of cross-cut test described in JIS G3312 12.2.5, and tape peeling was carried out. The percentage of the peeled area of the cross-cut portion (the number of peeled squares out of the 100 squares made by cross cutting) was determined, and coating adhesion was evaluated as acceptable (○) when the percentage was at most 1% and as unacceptable (X) when it exceeded 1%.

Post-Coating Corrosion Resistance:

After X-shaped scratches having a depth reaching the steel base metal were formed with a blade cutter in the coated surface of the electrocoated material, the material was subjected to the salt spray test set forth in JIS Z2371. After 960 hours, the maximum swelled width of the coating from the scratches was determined, and samples for which this width was at most 2 mm were evaluated as acceptable (○), and those for which it exceeded 2 mm were evaluated as unacceptable (X).

Weldability

Welding currents were determined under the following spot welding conditions. Specifically, the smallest current required for the nugget diameter (mm) to reach $4\sqrt{t}$ (t: plate thickness in mm) ($4\sqrt{t}$ current) and the current at which expulsion or surface flash began (flashing current) were determined. Samples for which the difference in current between the $4\sqrt{t}$ current and the flashing current was at least 1000 A were evaluated as acceptable (○) and those for which it was less than 1000 A were evaluated as unacceptable (X).

The above measurements and test results are shown in Table 2.

TABLE 2

| | Plated steel sheet for working (before hot press forming) | | | | Conditions for hot press forming | | | | |
|---|---|---|---|---|---|---|---|---|---|
| Run No. | Type of plating | Coating weight ($g/m^2$) | % Al in plated film | % Fe in plated film | Rate of temperature rise (° C./sec) | Heating temperature (° C.) | Temp. holding time (sec) | Heating time (min) | Temp. at pressing (° C.) |
| 1 | GA | 50 | 0.3 | 15 | 5 | 900 | 70 | 4 | 850 |
| 2 | GA | 65 | 0.25 | 13 | 5 | 900 | 70 | 4 | 850 |
| 3 | EG | 70 | —[1] | —[1] | 5 | 880 | 130 | 5 | 800 |
| 4 | FZ | 45 | —[1] | 15 | 5 | 880 | 130 | 5 | 800 |
| 5 | GI | 60 | 0.45* | 0.3 | 5 | 880 | 130 | 6 | 800 |
| 6 | GA | 60 | 0.4* | 14 | 5 | 900 | 70 | 4 | 850 |
| 7 | EG | 30* | —[1] | —[1] | 5 | 880 | 130 | 5 | 800 |
| 8 | AL* | 80 | 92 | 3 | 5 | 900 | 70 | 4 | 850 |
| 9 | GA | 50 | 0.3 | 14 | 20* | 900 | 200 | 4 | 850 |
| 10 | GA | 50 | 0.3 | 15 | 5 | 980* | 50 | 4 | 940 |
| 11 | GA | 50 | 0.3 | 15 | 5 | 900 | 550 | 12* | 850 |
| 12 | GA | 50 | 0.3 | 15 | 10 | 900 | 30 | 2* | 850 |
| 13 | GA | 50 | 0.3 | 15 | 5 | 900 | 0* | 3 | 850 |

| | After hot preress forming | | | | | | | | | | |
|---|---|---|---|---|---|---|---|---|---|---|---|
| | | | | Thickness (μm) | | | | | | | |
| Run No. | Intermetallic compound phase | Amount of Al in the film ($g/m^2$) | Amount of Al oxide in the film ($mg/m^2$) | Fe—Zn solid solution layer | Zinc oxide layer | Film cracking | Die scratches | Coating Adhesion | Post-coating corrosion resistance | Weldability | Remark[2] |
| 1 | None | 0.42 | 1.3 | 25 | 3 | None | None | ○ | ○ | ○ | This |
| 2 | None | 0.35 | 0.9 | 30 | 3 | None | None | ○ | ○ | ○ | This |
| 3 | None | —[1] | —[1] | 30 | 4.5 | None | None | ○ | ○ | ○ | This |
| 4 | None | —[1] | —[1] | 20 | 3 | None | None | ○ | ○ | ○ | This |
| 5 | Found* | 0.64* | 7* | 0 | 3 | Found | Found | X | X | ○ | Compar. |
| 6 | None | 0.6* | 6* | 25 | 4 | None | None | X | X | ○ | Compar. |
| 7 | Found* | —[1] | —[1] | 0 | 7* | — | Found | X | X | X | Compar. |
| 8 | Found* | 70* | — | 0 | — | Found | Found | ○ | X | ○ | Compar. |
| 9 | Found* | 0.4 | 4 | 0 | 10* | Found | Found | X | X | X | Compar. |
| 10 | None | 0.45 | 1.5 | 20 | 7* | None | None | X | X | X | Compar. |

TABLE 2-continued

| | | | | | | | | | | | |
|---|---|---|---|---|---|---|---|---|---|---|---|
| 11 | None | 0.5 | 1.7 | 20 | 7* | None | None | X | X | X | Compar. |
| 12 | Found* | 0.5 | 5 | 10 | 3 | Found | Found | ○ | X | X | Compar. |
| 13 | Found* | 0.4 | 1 | 5 | 3 | Found | Found | ○ | ○ | X | Compar. |

(Note)
[1]The plating film does not contain Al or Fe.
[2]This = Example of this invention; Compar. = Comparative example.

As shown in Table 2, in the examples according to the present invention (Nos. 1-4), hot press-formed articles could be manufactured without damage to dies, and they were excellent with respect to coating adhesion, post-coating corrosion resistance, and weldability.

In contrast, die scratches after pressing were observed for each of the hot press-formed articles in which an intermetallic compound phase remained in the vicinity of the surface (Nos. 5, 7, 8, 9, 12, and 13). These were examples in which the plating composition or the type of plating were different (Nos. 5 and 8), the coating weight of plating was too low (No. 7), the rate of temperature rise was too high (No. 9), or the holding time or the overall heating time was too short (Nos. 12 and 13). Examples for which the amount of Al and the amount of Al oxides in the surface layer were large (Nos. 5 and 6) were inferior with respect to coating adhesion and post-coating corrosion resistance. For each of these, the Al content in the plating film was large. In addition, examples for which the thickness of the zinc oxide layer (the oxide film) was large (Nos. 7, 9, 10, and 11) were inferior with respect to coating adhesion, post-coating corrosion resistance, and weldability. These were examples for which the coating weight of plating was too low (No. 7), the rate of temperature rise was too high (No. 9), the heating temperature was too high (No. 10), or the heating time was too long (No. 11). In addition, an example for which a steel sheet with hot-dipped aluminum plating was subjected to hot press forming (No. 8) had an intermetallic compound phase remaining, so the die was damaged, and it was also inferior with respect to post-coating corrosion resistance.

INDUSTRIAL APPLICABILITY

A hot press-formed article according to the present invention not only has excellent post-coating corrosion resistance but it also has excellent coating adhesion, so it is particularly useful for automotive parts such as suspension parts and reinforcing members. A manufacturing method for a hot press-formed article according to the present invention makes it possible to easily and stably manufacture such a hot press-formed article, resulting in a decrease in manufacturing costs and exhibiting a great effect in stably guaranteeing the quality of products.

The invention claimed is:

1. A hot press-formed and quenched hardened article formed by hot press-forming of a zinc-based plated steel material and hardened by quenching of the zinc-based plated steel material after hot press forming or during hot press forming, a base steel layer of the hot press-formed article having on its surface a zinc-based plating layer which comprises an iron-zinc solid solution phase and which has a thickness of at least 1 μm and at most 50 μm, with the average thickness of a zinc oxide layer, which may be present atop the zinc-based plating layer, being at most 2 μm, wherein the zinc-based plating layer consists essentially of an iron-zinc solid solution phase, which is in contact with the base steel layer.

2. A hot press-formed article as set forth in claim 1 wherein substantially no zinc oxide layer is present atop the zinc-based plating layer.

3. A hot press-formed article as set forth in claim 1 wherein the total amount of zinc in the zinc-based plating layer and the zinc oxide layer present on the surface of the steel material is at least 10 $g/m^2$ and at most 90 $g/m^2$.

* * * * *